US009683739B2

(12) United States Patent
Hicks

(10) Patent No.: US 9,683,739 B2
(45) Date of Patent: Jun. 20, 2017

(54) VARIABLE-AREA FUEL INJECTOR WITH IMPROVED CIRCUMFERENTIAL SPRAY UNIFORMITY

(75) Inventor: Paul G. Hicks, Holland, MI (US)

(73) Assignee: Woodward, Inc., Fort Collins, CO (US)

( * ) Notice: Subject to any disclaimer, the term of this patent is extended or adjusted under 35 U.S.C. 154(b) by 1494 days.

(21) Appl. No.: 12/615,073

(22) Filed: Nov. 9, 2009

(65) Prior Publication Data

US 2011/0108639 A1 May 12, 2011

(51) Int. Cl.
*F23D 11/38* (2006.01)
*F23D 11/26* (2006.01)

(52) U.S. Cl.
CPC ..... *F23D 11/383* (2013.01); *F23D 11/26* (2013.01); *F01N 2610/1453* (2013.01)

(58) Field of Classification Search
CPC . F23D 11/383; F23D 11/26; F01N 2610/1453
USPC ..... 239/461–524, 533.1–533.12, 533.7, 239/533.9, 533.8
See application file for complete search history.

(56) References Cited

U.S. PATENT DOCUMENTS 1,876,980 A * 9/1932 Lentell, Jr. ..... 239/466
1,952,816 A * 3/1934 Mock ..... 239/488
1,969,954 A * 8/1934 Taylor ..... 239/106
2,320,964 A 6/1943 Yates
2,410,946 A * 11/1946 Johnson ..... 137/541
2,710,600 A * 6/1955 Nallinger ..... 123/533
2,801,881 A * 8/1957 Campbell ..... 239/464
2,860,780 A * 11/1958 Ziesche et al. ..... 239/533.7
2,921,746 A * 1/1960 Burman ..... 239/453
2,974,881 A * 3/1961 Garday ..... 239/533.12
2,981,483 A * 4/1961 Pichon ..... 239/464
(Continued)

FOREIGN PATENT DOCUMENTS

CN 1461351 A 12/2003
CN 1512139 A 8/2009
(Continued)

OTHER PUBLICATIONS

U.S. Appl. No. 12/194,597, filed Aug. 20, 2008, Smith.
(Continued)

*Primary Examiner* — Arthur O Hall
*Assistant Examiner* — Steven M Cernoch
(74) *Attorney, Agent, or Firm* — Reinhart Boerner Van Deuren P.C.

(57) ABSTRACT

A fuel injector having a body with a bore, which defines a fuel manifold. The injector also has a variable-area injector arrangement having a pintle with a conical head and a pintle spring connected to the body. The pintle spring urges a tip of the pintle to seal against an exit orifice of the body, such that application of pressurized fuel within the body causes the pintle to move. Above some threshold pressure, the pressurized fuel causes the conical head to move out of contact with the exit orifice of the body. This, in turn, provides a corresponding variable area for passage of the pressurized fuel through the exit orifice about the conical head of the pintle. The injector further includes a swirler configured to create a swirling action in the flow of pressurized fuel through the fuel manifold, wherein the manifold is upstream of the exit orifice.

25 Claims, 5 Drawing Sheets

(56) References Cited

U.S. PATENT DOCUMENTS

| | | | | | |
|---|---|---|---|---|---|
| 3,116,019 | A | * | 12/1963 | Graef | 239/542 |
| 3,116,752 | A | * | 1/1964 | Duncan | 137/384.6 |
| 3,348,520 | A | * | 10/1967 | Lockwood | 118/667 |
| 3,391,910 | A | | 7/1968 | Prahl | |
| 3,398,936 | A | * | 8/1968 | Delano | 239/533.11 |
| 3,444,886 | A | * | 5/1969 | Bailey et al. | 137/541 |
| 3,662,959 | A | | 5/1972 | Sample, Jr. | |
| 3,738,976 | A | | 6/1973 | Heavin | |
| 3,907,209 | A | * | 9/1975 | Fiedler | 239/533.7 |
| 3,982,694 | A | * | 9/1976 | Bailey | 239/96 |
| 4,082,067 | A | | 4/1978 | Yanagihara | |
| 4,365,746 | A | * | 12/1982 | Tanasawa et al. | 239/125 |
| 4,394,970 | A | * | 7/1983 | Hofmann et al. | 239/453 |
| 4,549,696 | A | | 10/1985 | Gaskell | |
| 4,629,127 | A | * | 12/1986 | Kawamura et al. | 239/489 |
| 4,721,253 | A | * | 1/1988 | Noguchi et al. | 239/464 |
| 4,865,002 | A | | 9/1989 | Borst et al. | |
| 4,901,987 | A | | 2/1990 | Greenhill et al. | |
| 4,958,771 | A | | 9/1990 | Klomp | |
| 4,974,565 | A | * | 12/1990 | Hashimoto et al. | 239/464 |
| 4,991,780 | A | | 2/1991 | Kannan et al. | |
| 5,012,981 | A | * | 5/1991 | Holzgrefe et al. | 239/487 |
| 5,058,549 | A | * | 10/1991 | Hashimoto et al. | 123/298 |
| 5,058,808 | A | * | 10/1991 | Young | 239/464 |
| 5,072,885 | A | * | 12/1991 | Hans et al. | 239/466 |
| 5,522,550 | A | | 6/1996 | Potz et al. | |
| 5,587,076 | A | * | 12/1996 | Herzog | 210/461 |
| 5,713,327 | A | * | 2/1998 | Tilton et al. | 123/299 |
| 5,735,468 | A | | 4/1998 | Casey | |
| 5,930,999 | A | * | 8/1999 | Howell et al. | 60/737 |
| 6,042,028 | A | | 3/2000 | Xu | |
| 6,047,905 | A | * | 4/2000 | Honda et al. | 239/533.2 |
| 6,089,468 | A | * | 7/2000 | Bouti | 239/11 |
| 6,109,540 | A | | 8/2000 | Coldren et al. | |
| 6,302,080 | B1 | * | 10/2001 | Kato et al. | 123/295 |
| 6,349,886 | B1 | * | 2/2002 | Bouti | 239/11 |
| 6,405,935 | B2 | * | 6/2002 | Dantes et al. | 239/5 |
| 6,510,836 | B2 | * | 1/2003 | Ismailov | 123/299 |
| 6,644,269 | B2 | * | 11/2003 | Kato et al. | 123/305 |
| 6,823,833 | B2 | * | 11/2004 | Ismailov | 123/299 |
| 6,920,749 | B2 | | 7/2005 | Mansour et al. | |
| 7,216,632 | B2 | | 5/2007 | Nagatomo et al. | |
| 7,370,817 | B2 | * | 5/2008 | Tilton et al. | 239/585.5 |
| 7,464,885 | B1 | * | 12/2008 | Chang | 239/571 |
| 7,546,961 | B2 | | 6/2009 | Cristiani et al. | |
| 7,832,377 | B2 | | 11/2010 | Lee et al. | |
| 2003/0201344 | A1 | | 10/2003 | Wark | |
| 2004/0007210 | A1 | | 1/2004 | Tian et al. | |
| 2006/0157018 | A1 | | 7/2006 | Nakayama et al. | |
| 2007/0001033 | A1 | | 1/2007 | Pasquali et al. | |
| 2007/0119966 | A1 | * | 5/2007 | Dry et al. | 239/88 |
| 2008/0296415 | A1 | | 12/2008 | Biagetti | |
| 2008/0308064 | A1 | | 12/2008 | Yudanov | |
| 2009/0126687 | A1 | * | 5/2009 | Paterson | 123/445 |
| 2011/0108639 | A1 | | 5/2011 | Hicks | |
| 2012/0138710 | A1 | | 6/2012 | Hicks et al. | |

FOREIGN PATENT DOCUMENTS

| | | | |
|---|---|---|---|
| DE | 2941536 | A1 | 4/1981 |
| DE | 3737896 | A1 | 5/1989 |
| DE | 4127455 | A1 | 2/1993 |
| EP | 0354905 | A1 | 2/1990 |
| EP | 1375904 | A1 | 1/2004 |
| GB | 831477 | A | 3/1960 |
| GB | 2170269 | A | 7/1986 |
| JP | 04-140468 | A | 5/1992 |
| JP | 06-185431 | A | 7/1994 |
| JP | 7015266 | B2 | 2/1995 |
| JP | 7062522 | B2 | 7/1995 |
| JP | 8049513 | A | 2/1996 |
| JP | 10-299613 | A | 11/1998 |
| WO | WO 88/09869 | A1 | 12/1988 |

OTHER PUBLICATIONS

U.S. Appl. No. 12/199,376, filed Aug. 27, 2008, Hicks.
U.S. Appl. No. 12/233,671, filed Sep. 19, 2008, Lee et al.
U.S. Appl. No. 12/233,697, filed Sep. 19, 2008, Hicks et al.
U.S. Appl. No. 12/569,996, filed Sep. 30, 2009, Smith.
Fundamentals of Aircraft Gas Turbine Engines; date last visited Jul. 24, 2008; 4 pages printed from website http://64.78.42.182/sweethaven/Aviation/AvEngines01lessonMain.asp?iNum=0307.
Flow Curves of EPCO Production Nozzles; Brochure; Known prior to Dec. 1, 2010; 4 pages; EPCO The Engineered Products Company, Flint, MI.
Joe Escobar; PT6 Fuel Nozzles; Aircraft Maintenance Technology; Jul. 2007; 6 pages; http://web.archive.org/web/20071012121824/http://www.amtonline.com/publication/article.jsp?pubid=1&id=4199.

* cited by examiner

VARIABLE-AREA FUEL INJECTOR WITH IMPROVED CIRCUMFERENTIAL SPRAY UNIFORMITY

FIELD OF THE INVENTION

This invention generally relates to fuel delivery systems, and, more particularly, to fuel injectors for delivering fuel to the combustion chambers of combustion engines.

BACKGROUND OF THE INVENTION

Variable-area fuel injectors have been used in many applications relating to air-breathing propulsion systems, including, for example, in ramjets, scramjets, and in gas turbine engines such as those used in aviation. Ramjets, scramjets, and gas turbine engines typically include a section for compressing inlet air, a combustion section for combusting the compressed air with fuel, and an expansion section where the energy from the hot gas produced by combustion of the fuel is converted into mechanical energy. The exhaust gas from the expansion section may be used to achieve thrust or as a source of heat and energy.

Generally, some type of fuel injector is used in the combustion section for spraying a flow of fuel droplets or atomized fuel into the compressed air to facilitate combustion. In some applications of air-breathing propulsion systems including ramjets, scramjets, and particularly in gas turbine engines, which must run at variable speeds, variable-area fuel injectors have been used because they provide an inexpensive method to inject fuel into a combustor, while also metering the fuel flow without the need for an additional metering valve.

Typically, the fuel flow rate is controlled by the combination of a spring, the fuel pressure, and an annular area, which is increasingly enlarged as the fuel pressure is increased. This is unlike the operation of pressure-swirl atomizers where the pressure-flow characteristics are static, and are determined solely by the fixed injector geometry and the variable injection pressure. Generally, variable-area fuel injectors provide good atomization over a much wider range of flow rates than do most pressure-swirl atomizers. Additionally, with variable-area fuel injectors, the fuel pressure drop is taken at the fuel injection location, thus providing better atomization than typical pressure-swirl and plain-orifice atomizers.

However, throughout its operational pressure range, most variable-area fuel injectors do not provide optimal spray circumferential uniformity, or patternation. Typically, these conventional variable-area fuel injectors have slots or holes used to feed fuel to the fuel manifold which is upstream of the exit area. In general, this configuration does not prevent the formation of wakes in the fuel flow downstream of these slots or holes. Optimal patternation is desirable in order to avoid non-uniform fuel distribution, which can cause hot spots in air-breathing engines resulting in thermal distress and failure of the engine itself. Good patternation also helps avoid regions of high fuel concentration (i.e., rich regions) in combustors, which reduces fuel efficiency and leads to poor emissions quality.

In applications not related to air-breathing engines, poor patternation can also lead to failure of the device. One such application is the automotive engine exhaust treatment process in which fuel is used to increase the temperature of the engine exhaust. By increasing the temperature of the exhaust, downstream post-engine exhaust treatment devices, such as dosers and diesel particulate filters can operate more effectively. However, poor patternation can cause hot-spots in the matrix of both the doser and the diesel particulate filter, thus reducing the life of the matrix.

Therefore, it would be desirable to have a variable-area fuel injector that provides superior patternation throughout the operational fuel flow range. Embodiments of the invention provide such a variable-area fuel injector. These and other advantages of the invention, as well as additional inventive features, will be apparent from the description of the invention provided herein.

BRIEF SUMMARY OF THE INVENTION

In one aspect, embodiments of the invention provide a fuel injector having a body with a bore, which defines a fuel manifold. The injector has a variable-area injector arrangement having a pintle with a conical head and a pintle spring connected to the body. The pintle spring urges a tip of the pintle to seal against an exit orifice of the body, such that application of pressurized fuel within the body causes the pintle to move. Above some threshold pressure, the pressurized fuel causes the conical head to move out of contact with the exit orifice of the body. This, in turn, provides a corresponding variable area for passage of the pressurized fuel through the exit orifice about the conical head of the pintle. The injector further includes a fuel swirler configured to create a swirling action in the flow of pressurized fuel through the fuel manifold, wherein the manifold is upstream of the exit orifice.

In another aspect, embodiments of the invention provide the aforementioned fuel injector, wherein the amount of pressure needed to move the conical head of the pintle out of contact with the variable-area exit orifice is determined by a pre-load placed on the pintle spring.

In yet another aspect, embodiments of the invention provide the aforementioned fuel injector, wherein the pre-load is placed on the pintle spring by a retaining nut assembly, and the fuel swirler is configured to hold the pintle substantially centered within the injector body Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Embodiments of the invention address the aforementioned problem of poor patternation and the effects associated therewith as related to fuel injection, particularly in gas turbine and other air-breathing engines. To understand the solution to this problem, it is helpful to understand some of the causes. Poor patternation in fuel injectors may result from lack of concentricity between the fuel injector body and the fuel injector pintle. Also, wakes, present in the fuel flow, due to the geometry upstream of the fuel injector exit orifice can have a significant effect on fuel spray quality.

Figure 1:
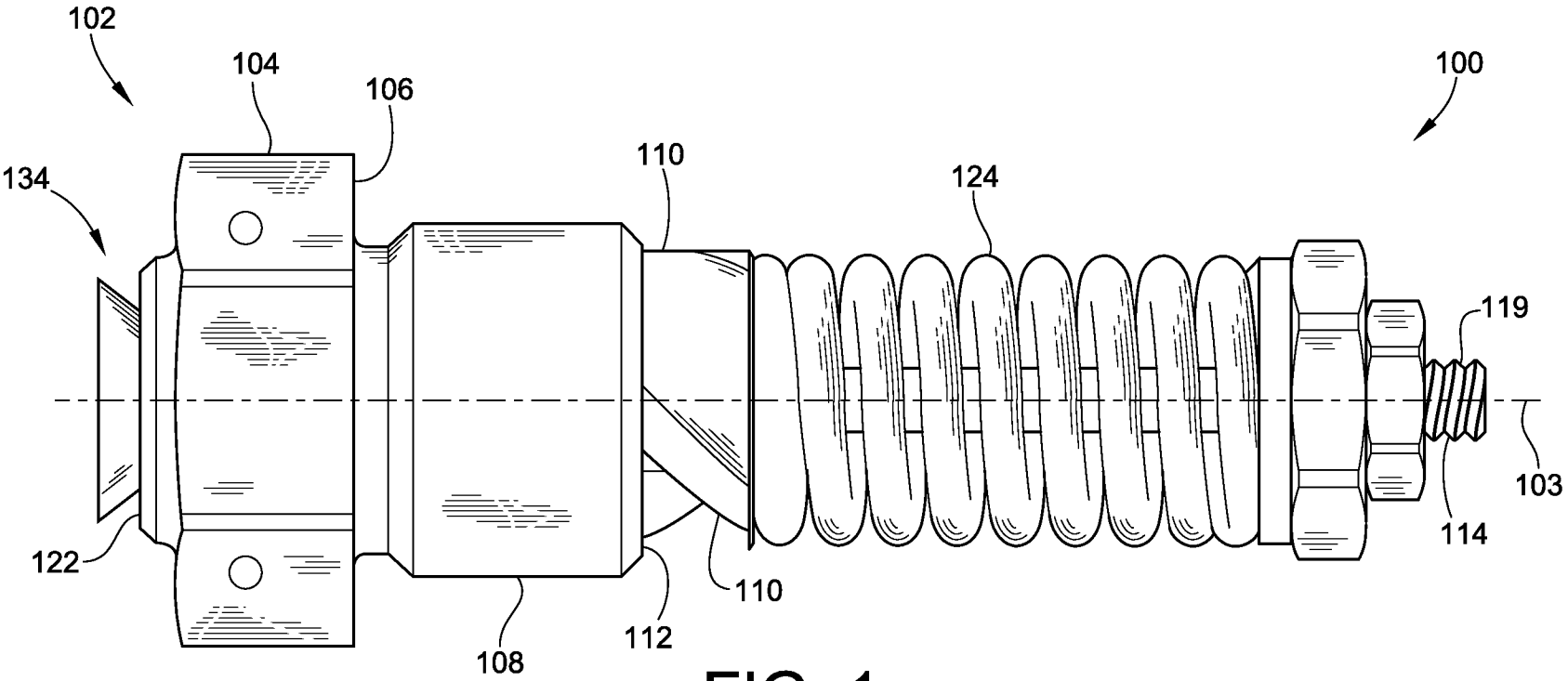
FIG. 1 is a plan view of a variable-area fuel injector according to an embodiment of the invention.
Figure 2:
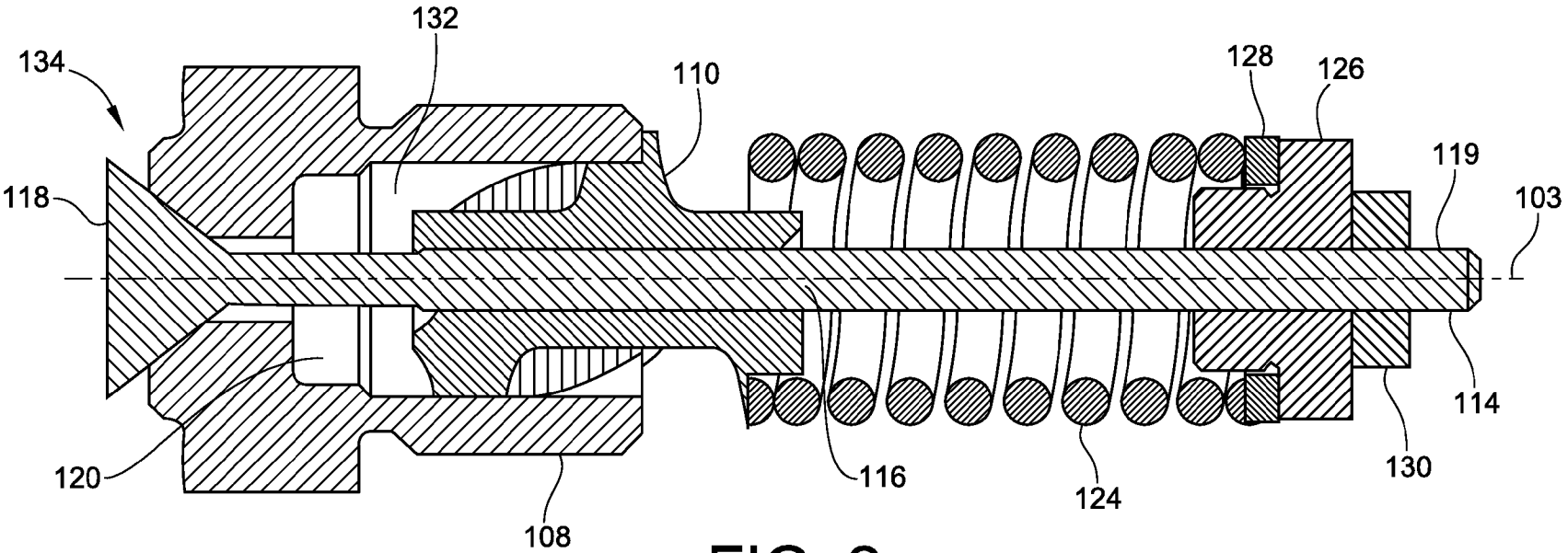
FIG. 2 is a cross-sectional view of the variable-area fuel injector of FIG. 1.

According to an embodiment of the invention, a variable-area injector 100, as illustrated in FIGS. 1 and 2, has a body 102 having a bore or opening 120 along a longitudinal axis 103 of the injector 100, and which includes a hexagonal outer surface 104, a sealing surface 106, and a threaded portion 108. In alternate embodiments, the outer surface 104 may be square, lobe-shaped, or of some other suitable shape that permits installation of the body using some type of readily available wrench or similar tool. In embodiments of the invention, a fuel swirler 110 is attached at a first end 112 of the body 102 in the longitudinal opening 120. This attachment of the fuel swirler 110 in the longitudinal opening 120 of the body 102 may be effected by brazing or welding. It is also contemplated that the fuel swirler 110 may be threaded or press fit into the opening 120, or keyed into the opening 120 via slots formed or machined into the walls of the opening 120. However, in alternate embodiments, the fuel swirler 110 is not fixedly attached to the body 102. During operation, the fuel swirler 110 is held in place by pressure from a spring 124, and by the fuel pressure. The variable-area injector 100 further includes a pintle 114, which, in this embodiment, has a relatively long, small-diameter cylindrical portion 116 and a conical head 118 at one end of the cylindrical portion 116. In one embodiment, a lower portion 119 of the cylindrical portion 116 is threaded During assembly of the variable-area injector 100, the pintle 114 will be inserted into the longitudinal opening 120 in the body 102. As explained above, the fuel swirler 110 is attached to the body 102 inside the longitudinal opening 120 at the first end 112. Typically, the cylindrical portion 116 of the pintle is inserted initially at a second end 122 of the body 102, such that when the pintle 114 is fully inserted, the cylindrical portion 116 is substantially centered in the longitudinal opening 120 and in a central opening in the fuel swirler 110, and the conical head 118 is seated in a variable-area exit orifice 134 at the second end 122 of the body 102.

The fuel swirler 110 is configured to hold the pintle 114 substantially in place during fuel-injector operation. The spring 124 is assembled over the cylindrical portion 116 until it abuts the fuel swirler 110. A retaining nut 126 and washer 128 are assembled onto the lower portion 119 of the pintle 114 such that the washer 128 abuts the spring 124. An optional lock nut 130 is assembled onto the lower portion 119 of the pintle 114 to ensure that the retaining nut 126 does not loosen. In an embodiment of the invention, the lower portion 119 is threaded allowing the retaining nut 126 to be threaded onto the pintle 114. In alternate embodiments of the invention, the retaining nut 126 is attached to the lower portion 119 by welding, brazing or other suitable means. The washer 128, retaining nut 126, and optional lock nut 130 are assembled to the pintle 114 so as to place a pre-load on the spring 124. The pre-load on spring 124 serves to keep the conical head 118 seated in the variable-area exit orifice 134.

In an embodiment of the invention, the variable-area fuel injector 100 is threaded into the wall of the combustor or of some other pressurized vessel, for example, the wall of the combustion chamber of a gas turbine engine (not shown), via the threaded portion 108 of the body 102. The outer surface 104, whether hexagonal, square, or lobe-shaped is configured to be gripped by a wrench, socket wrench, or some similar tool to facilitate assembly of the fuel injector 100 to the wall of the combustion chamber. The sealing surface 106 of the body 102 is configured to seal against the wall of the combustion chamber (not shown).

In operation, the conical head 118, the second end 122 of the body 102, and the outer surface 104 are exposed to the fuel-air combustion inside the combustion chamber. The threaded portion 108 of the body 102, the fuel swirler 110, the spring 124, cylindrical portion 116 of the pintle 114, along with the nuts 126, 130 and washer 128 are all exposed to pressurized fuel. When the fuel pressure is below some threshold value, the spring 124 keeps the conical head 118 of the pintle 114 seated in the longitudinal opening 120, such that no fuel flows into the combustion chamber. The threshold value is related to the amount of pre-load that has been applied to the spring 124 by the retaining nut 126 during assembly. However, when the fuel pressure exceeds the threshold value, the spring 124 is compressed as the conical head 118 is lifted away from the longitudinal opening 120, thus allowing fuel to flow through a fuel manifold 132, out of the variable-area exit orifice 134 surrounding the conical head 118 and into the combustion chamber (not shown).

The flow of pressurized fuel through the opening between the exit orifice 134 and the conical head 118 results in a "hollow cone" spray pattern of fuel from the fuel injector 100 into the combustion chamber (not shown). As the fuel pressure increases causing the conical head 118 of the pintle 114 to move further away from the longitudinal opening 120, the small diameter of the cylindrical portion 116 substantially replaces the larger conical head 118 in the exit orifice 134, thus increasing the flow area of the exit orifice. As a result of this variable-area feature, the size of the area available for fuel flow at the exit orifice 134 increases as the fuel pressure increases, thereby allowing fuel to flow into the combustion chamber at an increasing rate.

To prevent the formation of wakes, which cause poor patternation, in the fuel as it flows through the fuel manifold 132, the fuel swirler 110 causes the fuel to move in a spiraling motion as it moves through the fuel manifold 132, thus reducing or eliminating non-uniformities in the fuel flow. Additionally, the swirling action created by the fuel swirler 110 improves atomization of the fuel by thinning out the liquid sheet as it flows out of the variable-area injector 100 through the exit orifice 134. Further, the swirling action of the fuel flow helps to center the pintle 114 within the body 102 producing a more uniform spray pattern as a result of the vortex that forms in the fuel manifold 132 and exit orifice 134.

Figure 3:
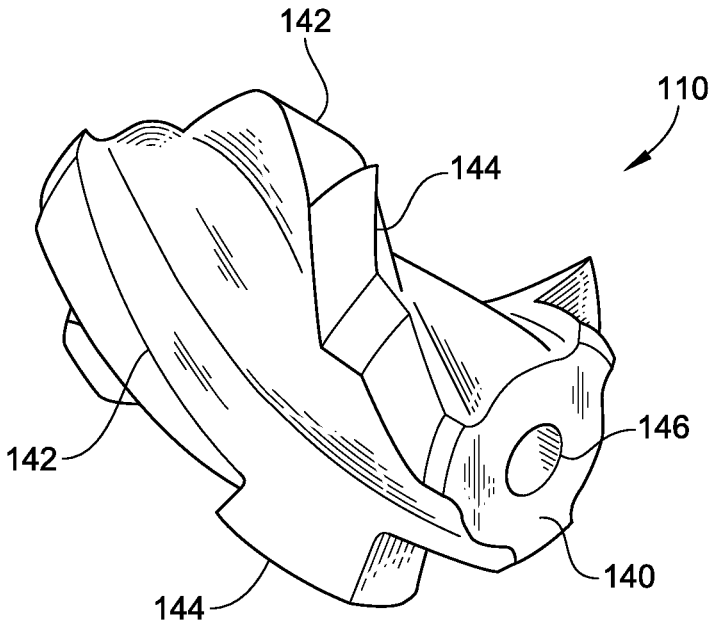
FIG. 3 is a perspective view of a fuel swirler according to an embodiment of the invention.

FIG. 3 shows a perspective view of the fuel swirler 110 incorporated into the fuel injector 100 of FIG. 2, according to an embodiment of the invention. The fuel swirler 110 has a generally cylindrical body 140 which has a plurality of integral vanes 142 that spiral around the outer surface of the cylindrical body 140. Each of the plurality of integral vanes 142 has a raised portion 144 configured to engage the wall of the opening 120 when the fuel swirler 110 is assembled to the body 102. The fuel swirler 110 includes a central opening 146 to accommodate the pintle 114 when the fuel swirler 110 is assembled into the body 102. When pressurized fuel flows around the fuel swirler 110 and into the fuel manifold 132, the fuel begins to swirl due to the spiraling shape of the plurality of integral vanes 142. As a result of this swirling action, non-uniformities, such as those caused by upstream wakes, in the fuel flow are reduced or eliminated. As mentioned above, the swirling action, especially at high flow rates, also tends to thin out the liquid sheet as it flows through the exit orifice 134, thus improving atomization of the fuel, which, in turn, improves combustion, leading to increased engine efficiency and less pollution. It is also contemplated that embodiments of the invention includes swirlers having a cylindrical body, in which the one or more vanes spiraling around the outer surface of the cylindrical body are not integral with the cylindrical body. The swirler 110 geometry can also include other designs. For examples, the vanes could be helical or straight, and the swirler 110 could be a "plug" with various orifices having angled geometries, or slots oriented to induce swirl into the fuel flow.

Figure 4A:
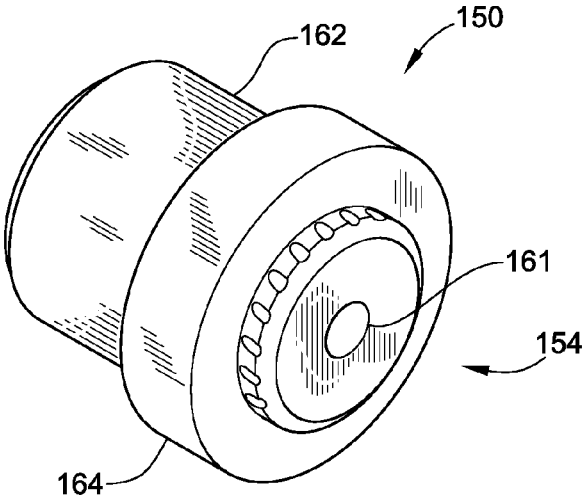
FIG. 4A is a perspective view of a fuel swirler according to another embodiment of the invention.
Figure 4B:
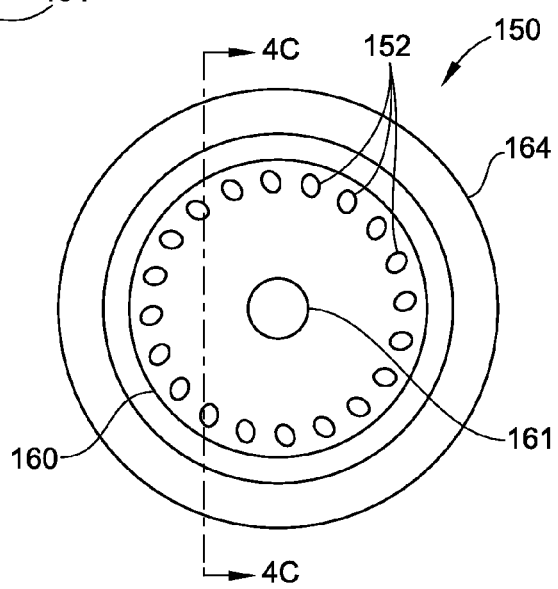
FIG. 4B is a plan view of the fuel swirler of FIG. 4A showing an end of the fuel swirler hidden in the perspective view of FIG. 4A.
Figure 4C:
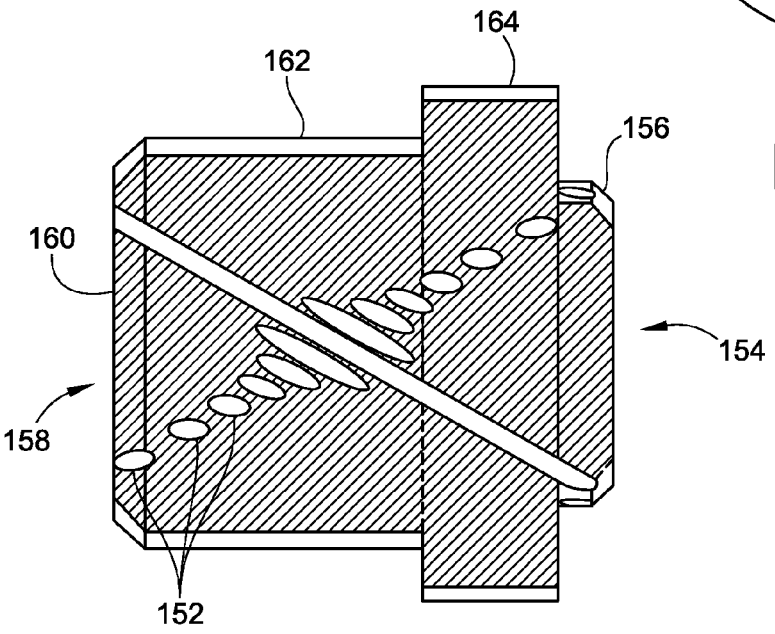
FIG. 4C is a cross-sectional view of the fuel swirler of FIG. 4A.

FIGS. 4A, 4B, and 4C illustrate one such alternate embodiment of a fuel swirler 150. FIG. 4A is a perspective view of the fuel swirler 150, which is essentially a cylindrical plug with a plurality of angled holes 152. At one end 154 of the fuel swirler 150 the plurality of angled holes 152 are drilled, or formed, in the side of a raised portion 156. At the other end 158 of the fuel swirler 150, shown in FIG. 4B, the plurality of angled holes 152 are located at evenly spaced intervals around the circumference of an end face 160. FIG. 4C is a cross-sectional view of the fuel swirler 150 that shows the path of the plurality of angled holes 152 through the body of the fuel swirler 150, according to an embodiment of the invention. It should be noted that the cross-section shown in FIG. 4C is not through the center of the fuel swirler 150. The plurality of angled holes 152 must be drilled, or formed, so as not to go through the center of the fuel swirler 150 due to the presence of the central opening 161.

Figure 5:
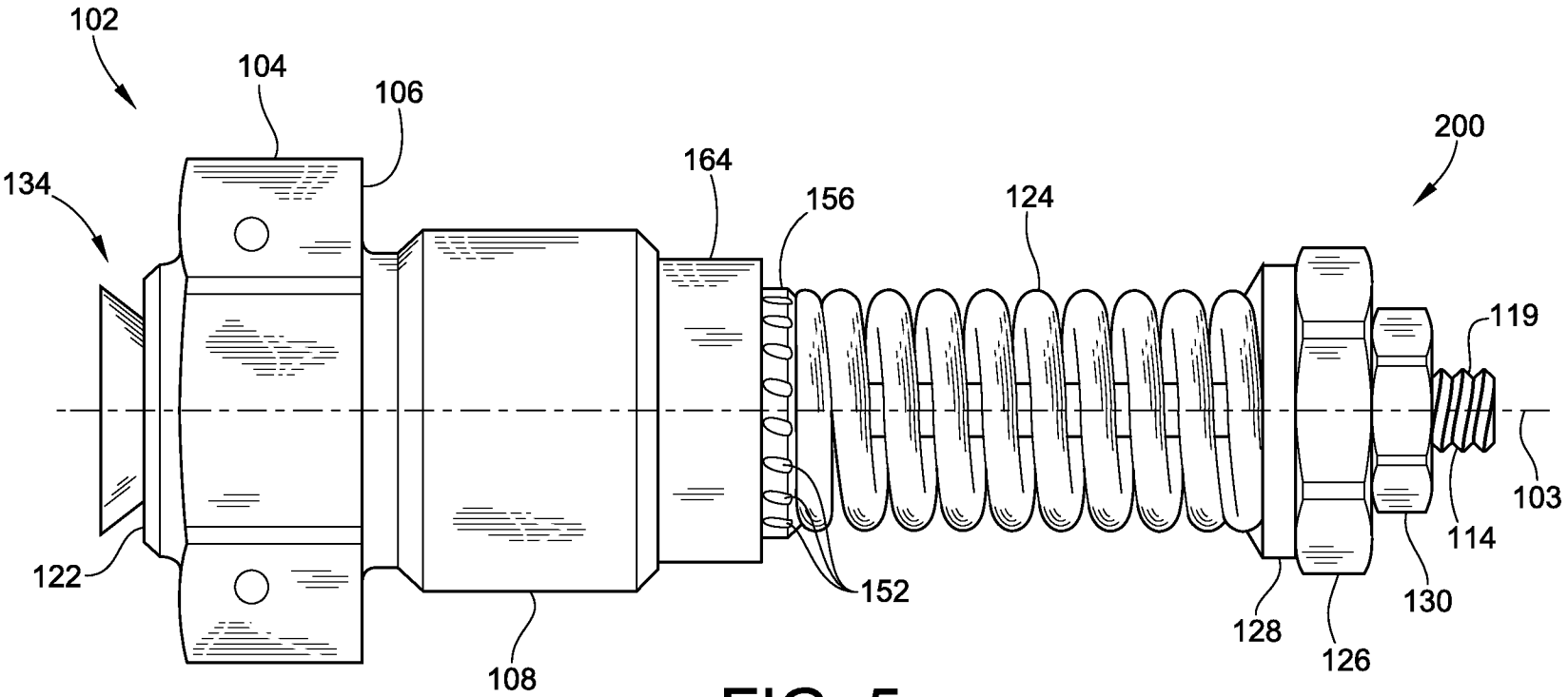
FIG. 5 is a plan view of the fuel swirler of FIG. 4A assembled into a fuel injector according to an embodiment of the invention.

FIG. 5 illustrates an exemplary fuel injector 200 incorporating the fuel swirler 150, according to an embodiment of the invention. During assembly, a cylindrical portion 162 of the fuel swirler 150 is inserted into the longitudinal opening 120 of the body 102 at the end 112. The fuel swirler 150 includes a central opening 161 to accommodate the cylindrical portion 116 (shown in FIG. 2) of the pintle 114 when the fuel swirler 150 is assembled into the body 102. A shoulder portion 164 is configured to abut the end 112 of the body 102 during assembly. The shoulder portion 164 can be attached to the body 102 by brazing, or by welding. In an alternate embodiment, the fuel swirler 150 can be press-fit, or threaded, into the longitudinal opening 120 of the body 102. The spring 124 will abut the raised portion 156. As in FIGS. 1 and 2, the washer 128, retaining nut 126, and optional lock nut 130 are assembled to the pintle 114 so as to place a pre-load on the spring 124. The pre-load on spring 124 serves to keep the conical head 118 seated in the variable-area exit orifice 134.

Referring still to FIG. 5, in operation, pressurized fuel enters the plurality of angled holes 152 on the side of the raised portion 156 of the fuel swirler 150. The pressurized fuel exits through each of the plurality of angled holes 152 at the end face 160. The pressurized fuel exits at an angle sufficient to cause the desired swirling action, which reduces or eliminates non-uniformities in the fuel flow.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fuel injector apparatus, comprising:

an injector body having a bore therethrough, the bore defining a fuel manifold;

a variable-area injector arrangement having a pintle with a conical head and a pintle spring operatively connected to the injector body in such a manner that the spring urges the conical head to seal against a variable-area exit orifice located at one end of the body to thereby prevent the passage of pressurized fuel through the variable-area exit orifice, and such that application of pressurized fuel within the injector body causes the pintle to move such that the conical head of the pintle is moved out of contact with the variable-area exit orifice of the body as a function of the pressure of the pressurized fuel in the injector body, to thereby provide a corresponding variable area for passage of the pressurized fuel through the variable-area exit orifice about the conical head of the pintle; and a fuel swirler positioned within the manifold and configured to create a swirling action in the flow of pressurized fuel within the fuel manifold, wherein the fuel manifold is upstream of the variable-area exit orifice.

2. The fuel injector apparatus of claim 1, wherein the fuel swirler is configured to hold the pintle substantially centered within the injector body.

3. The fuel injector apparatus of claim 2, wherein the fuel swirler is attached to the injector body by one of brazing and welding.

4. The fuel injector apparatus of claim 2, wherein the fuel swirler is press fit, threaded or keyed into the bore in the injector body.

5. The fuel injector apparatus of claim 2, wherein the fuel swirler is held in place by pressure from the pintle spring and by the fuel pressure.

6. The fuel injector apparatus of claim 1, wherein the amount of pressure needed to move the conical head of the pintle out of contact with the variable-area exit orifice is determined by a pre-load on the pintle spring.

7. The fuel injector apparatus of claim 6, wherein the pre-load is placed on the pintle spring by a retaining nut assembly.

8. The fuel injector of claim 7, wherein the retainer nut assembly comprises a retaining nut, a washer, and a locking nut.

9. The fuel injector apparatus of claim 1, wherein the injector body includes a threaded portion to facilitate assembly of the fuel injector into an engine.

10. The fuel injector apparatus of claim 1, wherein the injector body includes a hexagonal portion.

11. The fuel injector apparatus of claim 1, wherein the pintle includes a cylindrical portion having conical head at one end.

12. The fuel injector apparatus of claim 11, wherein the pintle includes a threaded portion onto which a retaining nut assembly can be attached.

13. The fuel injector apparatus of claim 12, wherein the retaining nut assembly is configured to be threaded onto the threaded portion to place a pre-load on the pintle spring.

14. The fuel injector apparatus of claim 1, wherein the pintle spring is a coil spring.

15. The fuel injector apparatus of claim 1, wherein the fuel swirler comprises a cylindrical body having one or more vanes that spiral around an outer surface of the cylindrical body.

16. The fuel injector apparatus of claim 15, wherein the vanes are integral with the cylindrical body.

17. A fuel injector, comprising:

an injector housing having an opening therethrough, the opening defining a fuel manifold;

an injector arrangement having a pintle with a conical head and a pintle spring operatively connected to the injector housing in such a manner that the spring urges a tip of the pintle to seal against an exit orifice of the body to thereby prevent the passage of pressurized fuel through the exit orifice, the injector arrangement being configured such that the conical head is moved out of contact with the exit orifice as a function of the pressure of the pressurized fuel in the injector housing; and a fuel swirler coupled to the injector housing and positioned within the fuel manifold, the fuel swirler configured to create a swirling action in the flow of pressurized fuel within the fuel manifold.

18. The fuel injector of claim 17, wherein the fuel swirler comprises a cylindrical body having one or more integral vanes that spiral around an outer surface of the cylindrical body.

19. The fuel injector of claim 17, wherein the fuel swirler is configured to hold the pintle substantially centered within the injector housing.

20. The fuel injector of claim 17, wherein the amount of pressure needed to move the conical head of the pintle out of contact with the exit orifice is determined by a pre-load on the pintle spring.

21. The fuel injector of claim 20, wherein the pre-load is placed on the pintle spring by a retaining nut assembly.

22. The fuel injector of claim 17, wherein the injector housing includes a threaded portion to facilitate assembly of the fuel injector into an engine.

23. The fuel injector of claim 17, wherein the pintle includes a cylindrical portion having the conical head at one end, and further includes a threaded portion, at the other end, onto which a retaining nut assembly can be attached.

24. The fuel injector of claim 17, wherein the fuel swirler comprises a cylindrical plug having a cylindrical body, a shoulder portion, and a plurality of angled holes configured to create a swirling motion in fuel exiting from the plurality of angled holes.

25. The fuel injector of claim 24, wherein the cylindrical body is configured to fit into the opening in the injector housing, and wherein the shoulder portion is configured to abut an end of the injector housing.

* * * * *